United States Patent [19]

Despries et al.

[11] Patent Number: 4,949,660

[45] Date of Patent: Aug. 21, 1990

[54] SAIL WINDER CONTROL SYSTEMS

[76] Inventors: Jean-Michel Despries, 10 Ter, Rue Croix Marigny, 50550 St-Vaast La Hougue; Jean-Marie Pasdelou, Résidence Pasteur, 50100 Cherbourg, both of France

[21] Appl. No.: 275,523

[22] Filed: Nov. 23, 1988

[30] Foreign Application Priority Data

Nov. 26, 1987 [FR] France ..... 87 16407

[51] Int. Cl.[5] ..... B63H 9/10

[52] U.S. Cl. ..... 114/106; 114/107

[58] Field of Search ..... 114/102–107

[56] References Cited

U.S. PATENT DOCUMENTS

| | | | |
|---|---|---|---|
| 3,132,620 | 5/1964 | Court | 114/106 |
| 4,240,369 | 12/1980 | Molz | 114/106 |
| 4,267,790 | 5/1981 | Hood | 114/106 |
| 4,480,570 | 11/1984 | Rosenfield et al. | 114/106 |
| 4,526,122 | 7/1965 | Kluckhuhn | 114/106 |

FOREIGN PATENT DOCUMENTS

| | | | |
|---|---|---|---|
| 0076878 | 4/1983 | European Pat. Off. | 114/106 |
| 2603551 | 3/1988 | France | 114/106 |

*Primary Examiner*—Sherman D. Basinger
*Assistant Examiner*—Clifford T. Bartz
*Attorney, Agent, or Firm*—Sandler, Greenblum, & Bernstein

[57] ABSTRACT

A sail winder, more particularly a mainsail winder tube, made of a tube or similar profile rotating about its axis under the action of a control system, to which the sail is rigidly connected and about which it winds, and wherein a control system, made of a toothed pulley, is accommodated inside the mast foot or beneath the mast foot.

The winder includes, for hauling the sail, a halyard passing in a higher portion of the winder tube over a pulley rigidly connected to the tube and rotating therewith, with the halyard passing inside the tube and exiting from the winder tube via another pulley rigidly connectd to a fixed portion of the winder.

7 Claims, 3 Drawing Sheets

SAIL WINDER CONTROL SYSTEMS

FIELD OF THE INVENTION

The present invention relates to improvements to devices, called winders, provided for modifying the surface of a sail by winding it. The winder is substantially made of a tube or profile, rotating about its axis under the action of a control system, to which the sail is rigidly connected and about which it winds.

The invention is intended for being applied more particularly, but non-exclusively to mainsail winders.

This winder, the tube or profile 1 of which is in the center of a centering tube 2 which is coaxial therewith, is, as shown in FIGS. 1 to 3 of the accompanying drawings, either placed outside the mast 3 or inside said mast, as shown in FIG. 4.

For obvious aerodynamic efficiency reasons, the tube or profile 1 has to be placed at a distance A which is as small as possible from the mast.

The elements determining the distance between the rear face of the mast and the winding tube axis are, on the one hand, the tube diameter B when the sail is completely wound (FIG. 2), and, on the other hand, the diameter C of the winding control assembly 4 causing the rotation of the winder tube (see FIG. 5).

If the diameter B is not very large, the control assembly diameter C should be as large as possible in order to reduce as much as possible the force to be exerted on the control rope in order to wind the sail under optimum conditions.

BACKGROUND OF THE INVENTION

The presently existing winding control systems require exerting a large force on the rope in order to control the winding.

These systems are as follows; and

One of these systems provides the control by a storage drum 4; in which instance, the winding profile has to be spaced apart from the mast by a large distance A', which is at least equal to the sum of the drum diameter D and of a quantity equal to the radius at level C.

Another system uses an endless screw. If in such a case the screw body diameter is less than the distance between the winder tube axis and the mast rear face, this device has the disadvantage of storing the control rope and consequently to be very time-consuming and difficult to position on the mast.

OBJECTS AND DETAILED DESCRIPTION OF THE INVENTION

The invention allows avoidance of these various disadvantages, and greatly reduces the distance between the mast rear face and the winder.

Figure 1:
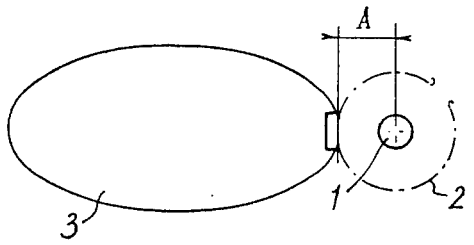
FIGS. 1 to 4 illustrate the winder tube and mast, with the winder tube being placed outside the mast in FIGS. 1–3, and inside the mast in FIG. 4.
Figure 2:
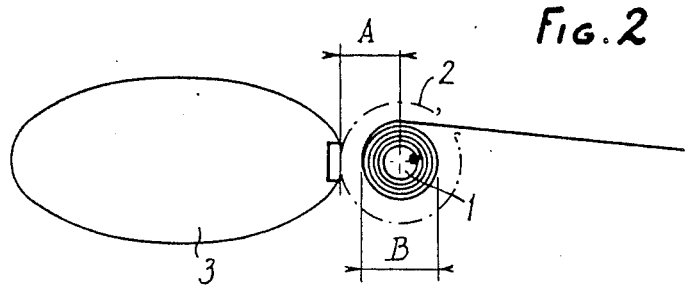
Figure 3:
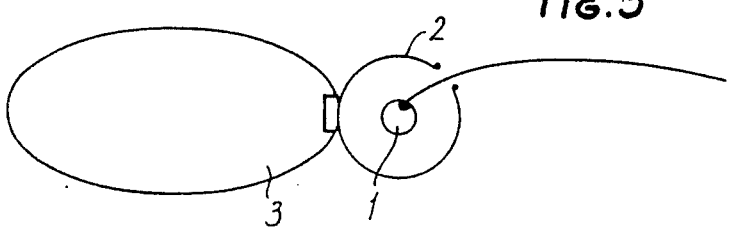
Figure 4:
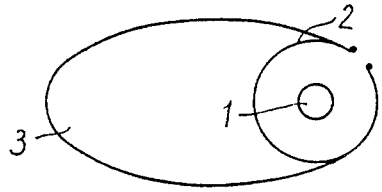
Figure 5:
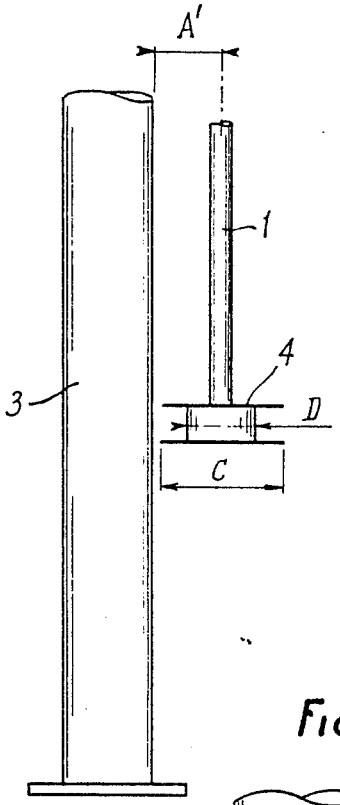
FIG. 5 illustrates a winder tube and mast combination wherein the diameter of the winding control bears a direct relationship to the distance between the winder tube and the mast.
Figure 6:
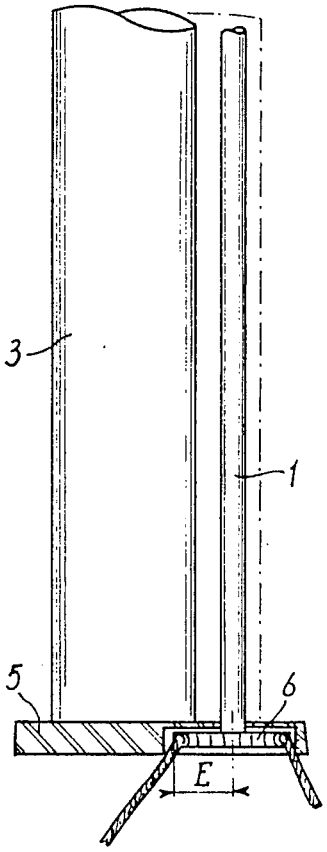
FIG. 6 illustrates the winders control system located beneath the foot of the mast.
Figure 7:
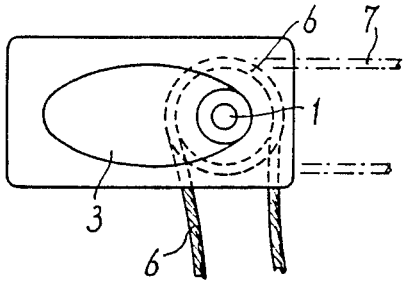
FIG. 7 illustrates the control rope exiting either in the axis of the mast or transversely thereto.

The present invention consists substantially, as shown in FIG. 6, in housing the winding control system inside the foot of mast 5 or underneath the foot, with the winding control system being advantageously formed of a toothed pulley 6. The advantages afforded by such a means include a small space requirement, a reversibility of the rotation direction of the winder, and a possibility of having the control rope 7 exiting either in the axis of the mast or transversely to said axis, as shown in FIG. 7.

Under such conditions and due to the invention, a direct relation between the winding control assembly diameter and the distance from the mast rear face to the axis of the winder tube 1 does not exist any more.

The torque exerted on the winding control assembly can be very large since the radius E of the toothed pulley is clearly superior to the radius of the winder tube 1.

Figure 8:
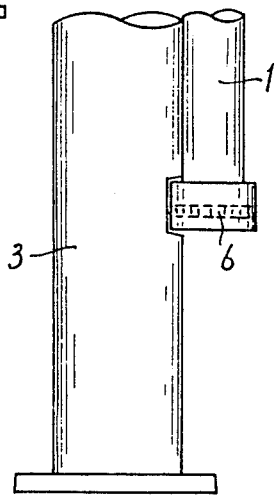
FIG. 8 illustrates the control assembly being provided in a recess provided on the mast.

The winding system made of a toothed pulley 6, as shown in FIG. 8, can also be provided above the connection fitting (not shown) between the spanker boom and the foot of the mast in recess provided in the mast 3. In such a case, the torque which will have to be exerted for rotating the tube will be larger than in the case where the system is accommodated within the foot of the mast or underneath said foot, but nevertheless less important than the one which has to be developed with the known systems.

Another improvement of the invention consists in a hauling up system of the sail on its winder.

In known systems, the sail is fixed at its lower portion to the base of the tube, or to the drum controlling the winding, whereby the higher portion of the sail can be stretched by a halyard.

The disadvantage resides in the fact that when the winding tube rotates, the halyard is also rotated, thereby causing its winding around about 10 to 20 turns over a very small height of 10 to 30 cm. In most cases, the halyard breaks or the winder gets jammed.

In order to remedy this disadvantage, there exist two main means for stretching the halyard.

The first consists in using a halyard of the boat and in interposing between the sail and the halyard, in its higher portion, a swivel block preventing the halyard from rotating. However, this solution is costly.

Another solution consists in using a halyard which is proper to the winder, holding the sail at the top and returning downwardly by a pulley.

This system is very simple but requires time for mounting the sail on the winder and for hauling it up. Moreover, the halyard is generally too short when one wishes to bring the sail down. Therefore, it is indispensable to lengthen the halyard with a section of rope. Moreover, one has to provide a hauling up system using a tackle or a lacing in order to stretch the halyard, but the mounting and dismounting of the sail on its winder are then lengthy operations.

The system according to the invention does away with these disadvantages.

Figure 9:
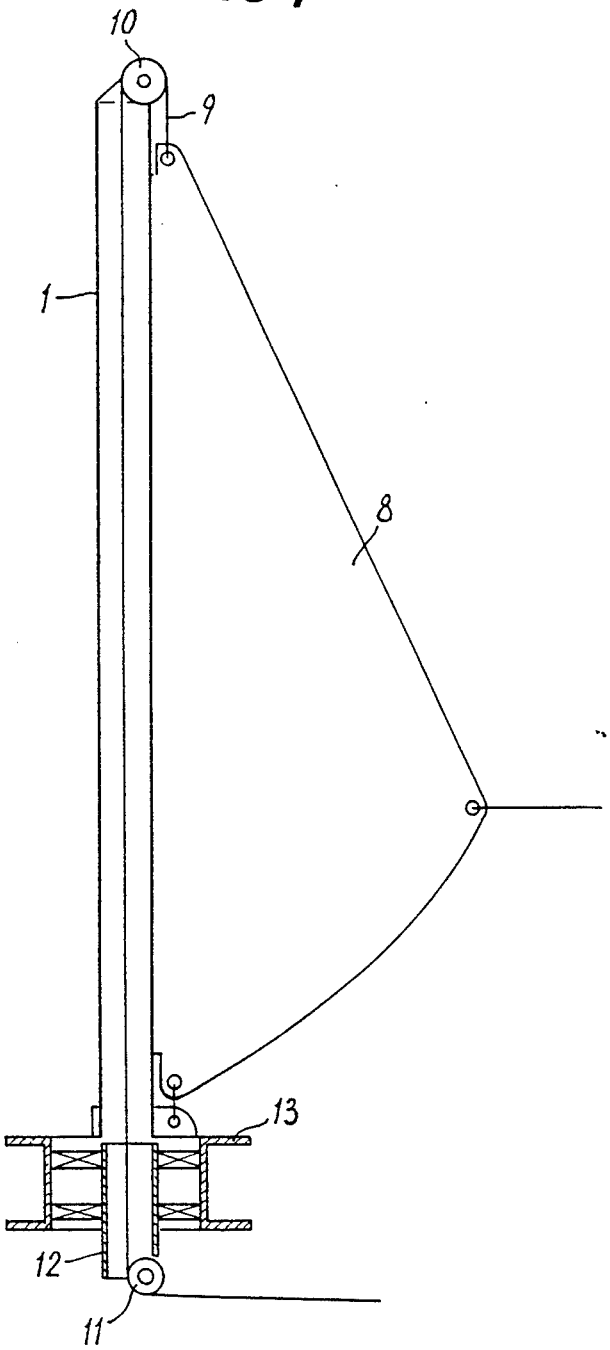
FIG. 9 illustrates a halyard assembly according to the present invention.

According to the invention (see FIG. 9), the sail 8 is stretched at its higher portion by a halyard 9, passing on a pulley 10, rigidly connected to the winder tube 1 and rotating therewith. The halyard extends along the winder tube axis and, in the lower portion of the winding control assembly, extends out on a pulley 11, rigidly connected to a fixed element, for example in the case in consideration to the shaft 12, secured against rotation, of the winding drum 13, or to any other portion of the mast or boat. Said pulley therefore cannot rotate.

The result is that: when the sail winder is rotated for example over 15 turns, the halyard also rotates about 15 turns at the top but does not rotate at the bottom and, due to the distance between the top and the bottom which can be from 10 to 20 meters, the halyard accepts without problem the twist of 1 to 2 turns per meter caused thereby. Therefore, the distribution of the twist of the sail over a considerable length has no disturbing consequence on its integrity and on the other hand cannot cause the blockage of the winding system.

The hauling up system according to the invention, using an internal halyard, allows in a very simple way hauling up a sail, such as with a slider, quickly and efficiently, and also bringing the sail rapidly down without it being necessary to lengthen the halyard.

Therefore, the system according to the invention allows combining the advantages of the known systems and eliminating their disadvantages. The system is very reliable since it includes no rotary parts and is very economical due to the very limited number of said parts.

The system according to the invention can be applied to mainsail winders mounted outside of the mast as well as to mainsail winders integrated to the mast, and also to jib winders.

We claim:

1. A sail winder comprising a tube that is rotatable about its longitudinal axis with said tube being mounted adjacent a mast and being connected to a sail around which tube the sail is adapted to wind; a control system for controlling rotation of said tube; and said mast having a foot portion, with said control system being at least partially positioned underneath the foot portion of said mast and at least partially extending past the foot portion.

2. A sail winder according to claim 1, wherein said control system includes a toothed pulley.

3. A sail winder according to claim 1, wherein said sail comprises a mainsail.

4. A sail winder according to claim 1, including a halyard for hauling up the sail; a pulley that is rigidly connected to an upper portion of said tube and rotatable therewith; a pulley rigidly connected to a fixed element; and wherein said halyard passes into said tube over said pulley that is rotatable with said tube, continuing through said tube and exiting from said tube over said pulley that is rigidly connected to a fixed element.

5. A sail winder according to claim 4, wherein said element comprises a shaft, and said control system includes a winding drum, with said shaft being secured against rotation of the winding drum of said control system.

6. A sail winder comprising a tube that is rotatable about its longitudinal axis with said tube being mounted adjacent a mast and being connected to a sail around which tube the sail is adapted to wind; a control system for controlling rotation of said tube; a halyard for hauling up the sail; a pulley that is rigidly connected to an upper portion said tube and rotatable therewith; a pulley rigidly connected to a fixed element; and wherein said halyard passes into said tube over said pulley that is rotatable with said tube, continuing through said tube and exiting from said tube over said pulley that is rigidly connected to a fixed element.

7. A sail winder according to claim 6, wherein said element comprises a shaft, and said control system includes a winding drum, with said shaft being secured against rotation of the winding drum of said control system.

* * * * *